United States Patent [19]

Doom

[11] 4,155,658

[45] May 22, 1979

[54] CONTINUOUS MIXER

[76] Inventor: Lewis G. Doom, 95 Meadow Farm Rd., East Islip, N.Y. 11730

[21] Appl. No.: 883,283

[22] Filed: Mar. 3, 1978

Related U.S. Application Data

[62] Division of Ser. No. 604,026, Aug. 12, 1975, Pat. No. 4,092,738.

[51] Int. Cl.[2] ..... B01F 15/00

[52] U.S. Cl. ..... 366/302

[58] Field of Search ..... 366/292, 293, 302–305, 366/241, 244, 279

[56] References Cited

U.S. PATENT DOCUMENTS

| | | | |
|---|---|---|---|
| 1,910,234 | 5/1933 | Boynton | 366/279 X |
| 2,504,337 | 4/1950 | Loomis | 366/297 |
| 2,991,051 | 7/1961 | Jones | 366/279 |
| 4,092,738 | 5/1978 | Doom | 366/304 |

*Primary Examiner*—Leonard D. Christian

*Attorney, Agent, or Firm*—Francis J. Murphy

[57] ABSTRACT

Mixing apparatus includes a rotor having at least one rotor surface comprising a non-cylindrical surface of revolution about the rotor shaft axis and a stator having at least one stator surface which is substantially reciprocal in shape to the rotor surface. The rotor and stator surfaces have pluralities of mixing teeth attached to and projecting outwardly from these surfaces such that the teeth on the rotor surfaces intermesh with those on the stator surfaces. These mixing teeth may be tapered preferably on both their circumferential and radial sides.

8 Claims, 11 Drawing Figures

CONTINUOUS MIXER

This is a divisional application of copending application Ser. No. 604,026, filed Aug. 12, 1975, now U.S. Pat. No. 4,092,738.

BACKGROUND OF THE INVENTION

In the processing industries, it is customary to blend fluid and semi-fluid materials under pressure by passing them through a continuous mixer which includes a mixing head. This mixing head includes a rotor member having a plurality of teeth extending outwardly from its outer surface. A stator member is disposed about the rotor member and includes circumferentially disposed rows of teeth which are arranged to interdigitate with the rotor teeth. Material is inserted into the mixer under pressure and passes between the interdigitated teeth of the rotor and stator causing it to be beaten and mixed.

In prior art apparatus of this type the rotor was a disc having circumferential rings of teeth extending outwardly from its opposed surfaces. The stator in turn surrounded the rotor and included two members with substantially planar stator surfaces having circumferential rings of stator teeth mounted thereon which intermesh with the rotor teeth on each of the opposed rotor surfaces. The planar type stator members used in this prior art apparatus had to be made relatively thick and therefore heavy in order to withstand the substantial forces generated during mixing since unlike the rotor member forces on the stator members are unbalanced. In addition the disc shaped rotor used in such a configuration was a solid member making it difficult to dissipate the undesirable heat resulting from the mixing operation, which if not adequately dissipated requires additional processing steps and added cost.

In an attempt to avoid the above described disadvantages rotors have been designed in a cylindrical configuration with teeth extending radially outwardly from the cylindrical surface. The stator of such a mixing head is a hollow cylinder with inwardly extending teeth which are again arranged to interdigitate with the outwardly extending rotor teeth. Such a mixing head has advantages from the standpoint of reduced stator weight and improved heat dissipation but has mechanical disadvantages; since only one surface on each of the rotor and stator are available for mixing teeth. In general, since it is advantageous to have as many mixing teeth as possible, the cylindrical head must be made undesirably long to provide adequate surface area for teeth. In addition it is mechanically convenient to have the material enter the head along the rotor shaft and with the cylindrical type of rotor, means must be provided to insure that this material is substantially equally distributed about the cylindrical rotor surface.

The teeth of prior art mixing heads were substantially rectangular in configuration and were substantially identical in shape at all points on both the rotor and stator surfaces. Material entering the mixing head of a mixer utilizing such prior art teeth tended to remain axially stratified as it passed between the rotor and the stator because insufficient mixing occurred in an axial direction which is the direction extending along the projecting teeth. It is also necessary to provide teeth having an adequate cross sectional area in order to make them strong enough to withstand periodic impact forces which are generated during disassembly of the head for cleaning and maintenance and which can result when hard pieces of foreign material are within the material to be mixed. Providing rectangular teeth having the minimum cross sectional area needed to provide this strength would limit the number of teeth which could be provided on the available rotor and stator surfaces. As indicated above it is advantageous to provide a maximum number of teeth per unit area on these surfaces to insure the best mixing characteristics of the resulting mixing head.

Applicant has solved the above described problems by providing a mixing head having a conically shaped rotor and stator members and teeth with a unique, tapered configuration. The conical stator provides a saving in weight over planar type stators while still providing a component of superior strength. The conical rotor may be conveniently made hollow to provide a cavity which may be utilized for a circulating coolant if desired to improve the heat dissipation of the head. The novel tooth configuration disclosed provides a maximum packing density of teeth on the available rotor and stator surfaces while providing strong teeth which resist breakage. The inventive tooth configuration also provides superior mixing in an axial direction along the projecting teeth. Larger heavier teeth of special shape are also provided in the area where the material enters the head. These larger teeth provide increased radial mixing in this area and provide greater resistance to breakage by foreign material introduced into the head.

SUMMARY OF THE INVENTION

Mixing apparatus includes a rotatable shaft, a rotor member and a stator assembly. The rotor member, which is attached to the shaft, has at least one rotor surface comprising a non-cylindrical surface of revolution about said shaft. A plurality of rotor teeth are attached to and extend outwardly from the rotor surface. A stator assembly includes at least one stator member having a stator surface which is substantially reciprocal in shape to said rotor surface and is disposed adjacent to said rotor surface. A plurality of stator teeth are attached to and project outwardly from the stator surface such that the stator teeth interdigitate with rotor teeth on the adjacent rotor surfaces.

Rotor and stator teeth, which are tapered on their radial and/or circumferential sides, may be provided to improve mixing in a direction along the projecting teeth and to provide more teeth per unit area on the rotor and stator surfaces. Specially configured larger teeth having a leading radial surface which intersect the respective rotor and/or stator surface at an angle may be provided to improve axial mixing. An additional agitator assembly may be provided at the input to the mixing apparatus to preblend the incoming material.

DESCRIPTION OF THE INVENTION

Figure 1:
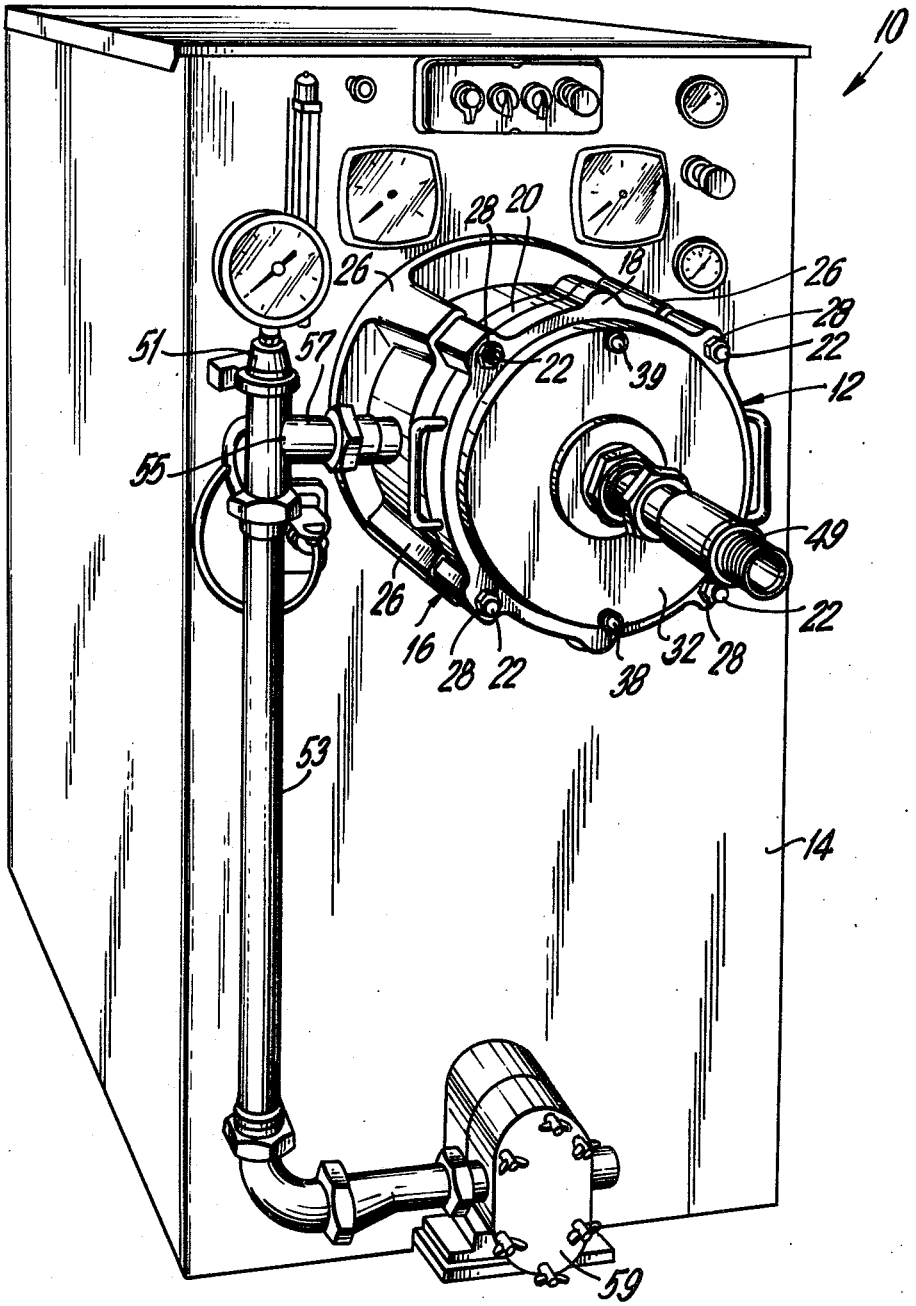
FIG. 1 is a perspective view of the exterior of a continuous mixer.

FIG. 1 shows the exterior of a continuous mixer 10 including a mixing head 12 mounted on a cabinet 14. The interior of the head 12 is shown in partial cross section in FIG. 2. A stator assembly 16 includes a front substantially conical stator member 18 and a rear substantially conical stator member 20. The stator members 18 and 20 are joined about their periphery by a plurality of studs 22 which extend into threaded apertures 24 formed in mounting brackets 26 which extend outwardly from cabinet 14. Nuts 28 cooperate with the threaded studs 22 to hold the conical stator members 18 and 20 together to form a central mixing cavity 30. A circular notched portion 19 on rear stator member 20 mates with a ring-like projecting portion 17 on front stator portion 16 and an O-ring seal 21 is provided between stator portions 18 and 20. A cooling housing 32 extends outwardly from the exterior surface 34 of the front stator member 18 to define a cavity 36 through which coolant may be circulated to cool the mixing head. Input ports such as 38 are provided through which the coolant may be introduced into cavity 36. A second cooling housing 40 extends outwardly from the outer surface 42 of rear stator member 20 to define a second cooling cavity 44. The exterior surface 34 of front stator member 18 extends outwardly to form a centrally disposed circular flange 46 defining an output aperture 48 disposed along the central axis of stator assembly 16. Additional output means such as the pipe 49 shown in FIG. 1 may be attached to flange 46 to conduct the output of the mixer 10 to further processing apparatus. The first cooling housing 32 is fixedly attached to exterior surface 34 of stator member 18 at a first circle of points 50 adjacent to the exterior periphery of member 18 and at a second circle of points 52 adjacent to central circular flange 46.

The rear stator member 20 flares outwardly in portion 54 to form a cylindrical housing 56 disposed along the central axis of the head 12. An inlet aperture 58 is formed in one side of this housing 56 to permit ingress of the semi-fluid mixture which is to be mixed in the head. Inlet pipe 57 as shown in FIG. 1 connects inlet aperture 58 with T junction 55. Junction 55 is in turn connected to a pump 59, which is not shown in detail but is known in the art, through pipe 53 and to aerating apparatus which is not shown but is known in the art through pipe 57. The material to be mixed is supplied under pressure by pump 59 to junction 55. From junction 55 the material passes through pipe 57, where it is aerated if desired, then through inlet aperture 58 to housing 56.

Figure 2:
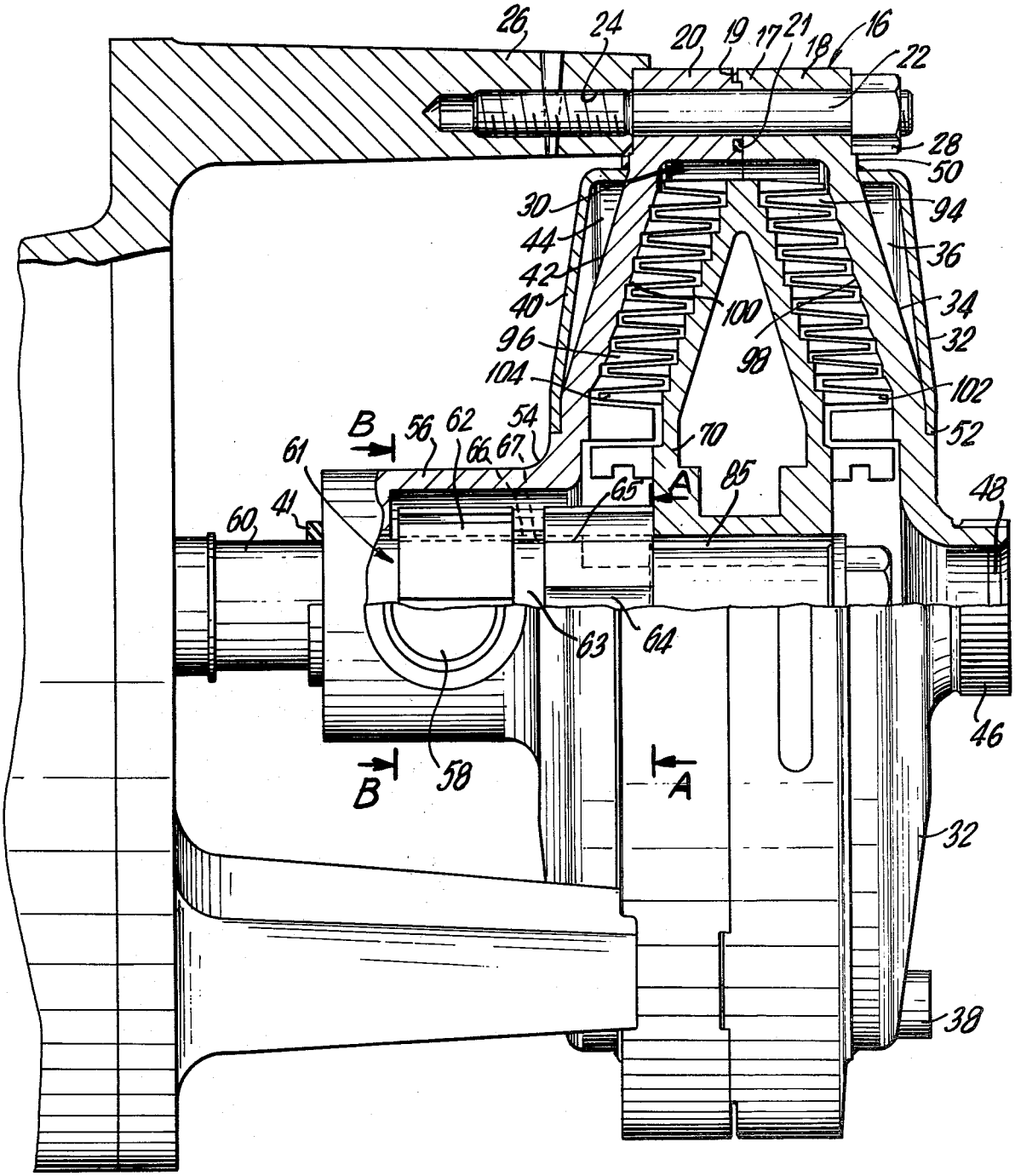
FIG. 2 is a sectional view of a mixing head in accordance with the invention.
Figure 10:
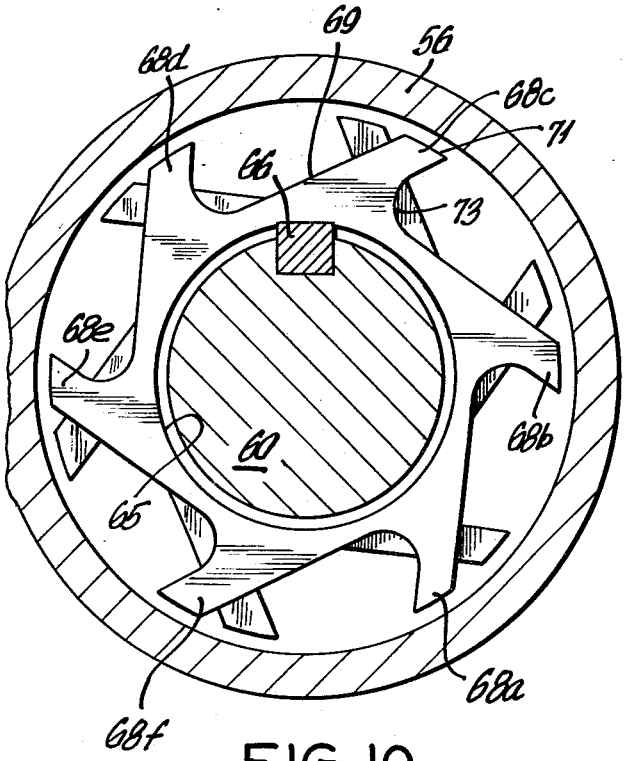
FIG. 10 is a sectional view taken along plane B—B of FIG. 2.
Figure 11:
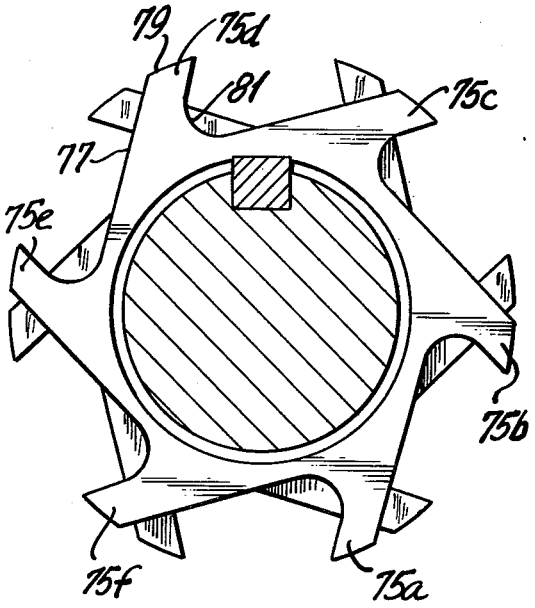
FIG. 11 is a sectional view taken along plane A—of FIG. 2.

As best seen in FIG. 2, a rotatable shaft 60 is arranged along the central axis of the head 12 and means including motors and driving devices which are not shown but are well known in the art are provided within the cabinet 10 to rotate the shaft 60. A seal 41 is provided about shaft 60 at the point where shaft 60 enters housing 56 to prevent material from escaping from housing 56. An agitator assembly 61 may be mounted on the shaft 60 adjacent to input aperture 58 of housing 54. The agitator assembly 61 includes a first agitator 62 mounted adjacent to input aperture 58 and a second agitator 64 mounted adjacent to the point at which the exterior surface 42 of rear stator 20 flares outwardly to form portion 54. The configuration and function of the agitators 62 and 64 will be described in detail below and is shown in FIGS. 9, 10 and 11.

Figure 9:
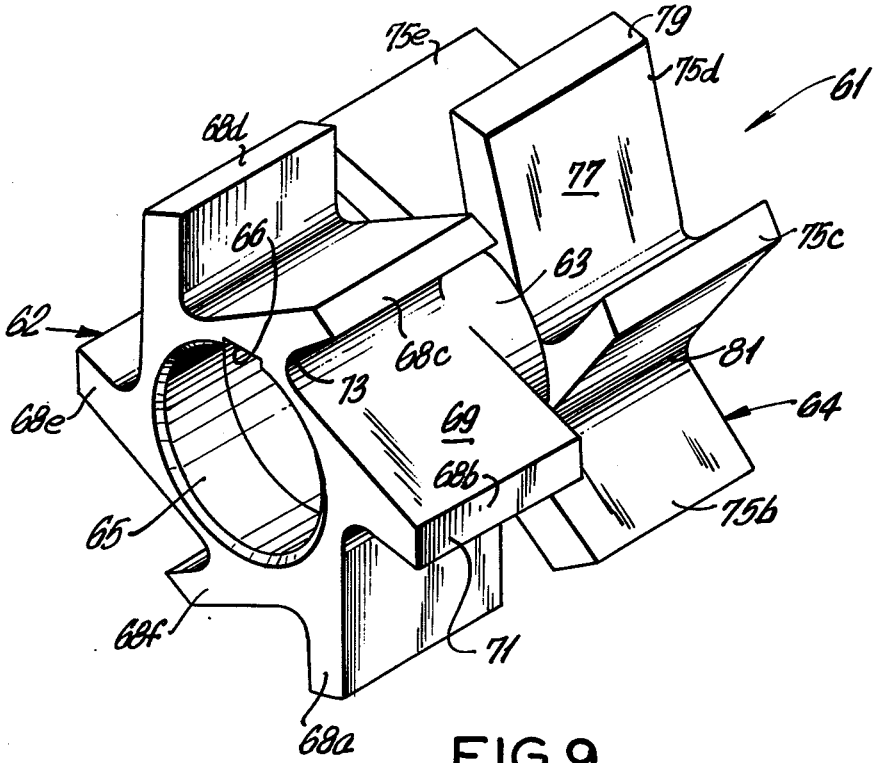
FIG. 9 is a perspective view of the agitator assembly utilized with the mixing head of FIG. 2.

The agitator assembly 61 shown in detail in FIG. 9 includes a first agitator 62 and a second agitator 64 mounted at spaced longitudinal points along a cylindrical member 63. The inner surface 65 of the cylindrical member is configured to fit slidably over rotatable shaft 60 and includes a keyway 66 by which the agitator assembly may be detachably mounted on shaft 60 as seen in FIG. 2 by a key 67, as shown in FIG. 2. The first agitator 62 includes a plurality of blades 68(*a*) through 68(*f*) which extend outward from cylindrical member 63. Each of the blades 68 include a first sloping surface 69, a top surface 71 and a curved surface 73 linking the top surface 71 to the sloping surface 69 of the following blade. As best seen in FIG. 9 the sloping surfaces 69 of the blades 68 are substantially tangent to and extent outwardly in a clockwise direction, as seen in FIG. 10, from cylindrical member 63. The second agitator 64 is attached to the common cylindrical member 63 and includes a plurality of blades 75(*a*) through 75(*f*). As in the case of blades 68 the blades 75 include a first sloping surface 77, a top surface 79 and a curved surface 81 extending between top surface 79 and the beginning of the sloping surface 77 of the next adjacent blade. The sloping surfaces 77 of the blades 75 of agitator 64 slope outwardly in a counterclockwise direction as seen in FIG. 10. Agitator 62 and 64 of agitator assembly 61 are identical except that their blades 68 and 75 slope in opposite directions with respect to each other as described above.

Figure 3:
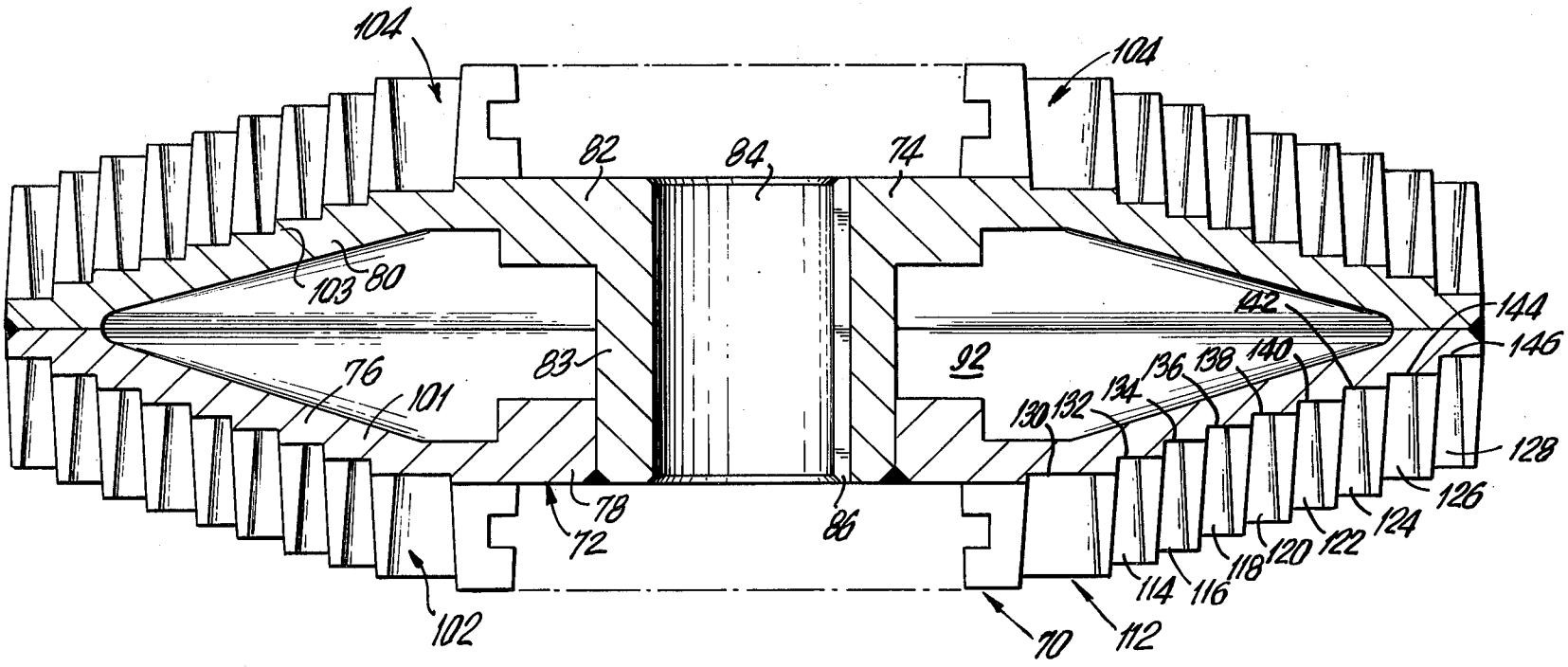
FIG. 3 is an enlarged sectional view of the rotor member of the mixing head of FIG. 2.

Continuing outwardly along shaft 60 from agitator assembly 61 a rotor member 70 is attached to the shaft 60 so as to be rotatable within the mixing cavity 30 defined by the hollow stator 16. As is best seen in FIG. 3, the rotor member 70 includes a front portion 72 and a rear portion 74. The front rotor portion 72 includes a circumferentially disposed conical surface 76 arranged about its periphery and a circumferentially disposed planar surface 78 arranged about its axis to form a first truncated conical surface. Rear rotor portion 74 is identical to front rotor portion 72 including a circumferentially disposed conical surface 80 and a planar portion 82 disposed about the axis of the rotor member 70 forming a second truncated conical surface opposed to the surface of the front rotor portion 72. A central aperture 84 in rotor 70 is defined by cylindrical wall 83. Aperture 84 extends through the front and rear rotor portions 72 and 74 through flaten surfaces 78 and 82, respectively. Aperture 84 is configured to fit slidably over shaft 60 and is fixedly attached to shaft 60 by a rotor key 85 shown in FIG. 2 which mates with keyway 86. Rotor member 70 is preferably hollow as shown in FIG. 3 to provide a cooling chamber 92. The inner surfaces 88 and 90 of rotor portions 72 and 74 define a cooling cavity 92 disposed about the central axis of the rotor member 70. If desired, two or more apertures may be provided through the member 70 preferably along shaft 60 to permit the introduction of a coolant into cavity 92 to provide heat dissipation in the rotor member 70.

A first and second substantially identical circumferentially disposed arrays of stator teeth 94 and 96 partially shown in FIG. 2 extend into the mixing cavity 30 from the inner concave conical surfaces 98 and 100 of stator members 18 and 20, respectively. A first and second substantially identical circumferentially disposed arrays of rotor teeth 102 and 104 extend outwardly respectively from convex conical surfaces 101 and 103 of rotor portions 72 and 74 of rotor 70. Stator tooth array 98 is arranged to interdigitate with rotor tooth array 102 when shaft 60 and attached rotor 70 rotates. Similarly stator tooth array 96 is arranged to interdigitate with rotor tooth array 104 during rotation of rotor 70.

The above discussion has been in terms of a two sided rotor member 70 having two opposed truncated conical rotor portions 72 and 74 mounted between two concave truncated conical stator members 18 and 20. It must be appreciated however that the invention is not limited to this embodiment and would include in general terms a rotor in the shape of any non-cylindrical surface of revolution generated about the axis defined by shaft 60 which would include but is not limited to regular figures of this type such as a cone, spheroid, paraboloid or hyperboliod. In addition, one or two stator members can be used as well as a rotor member having one or two rotor surfaces. For purposes of this invention the rotor member may be either convex, concave or some combination of the two so long as the cooperating stator member has a reciprocal shape. That is, of course, equally true of each of the stator members.

Figure 4:
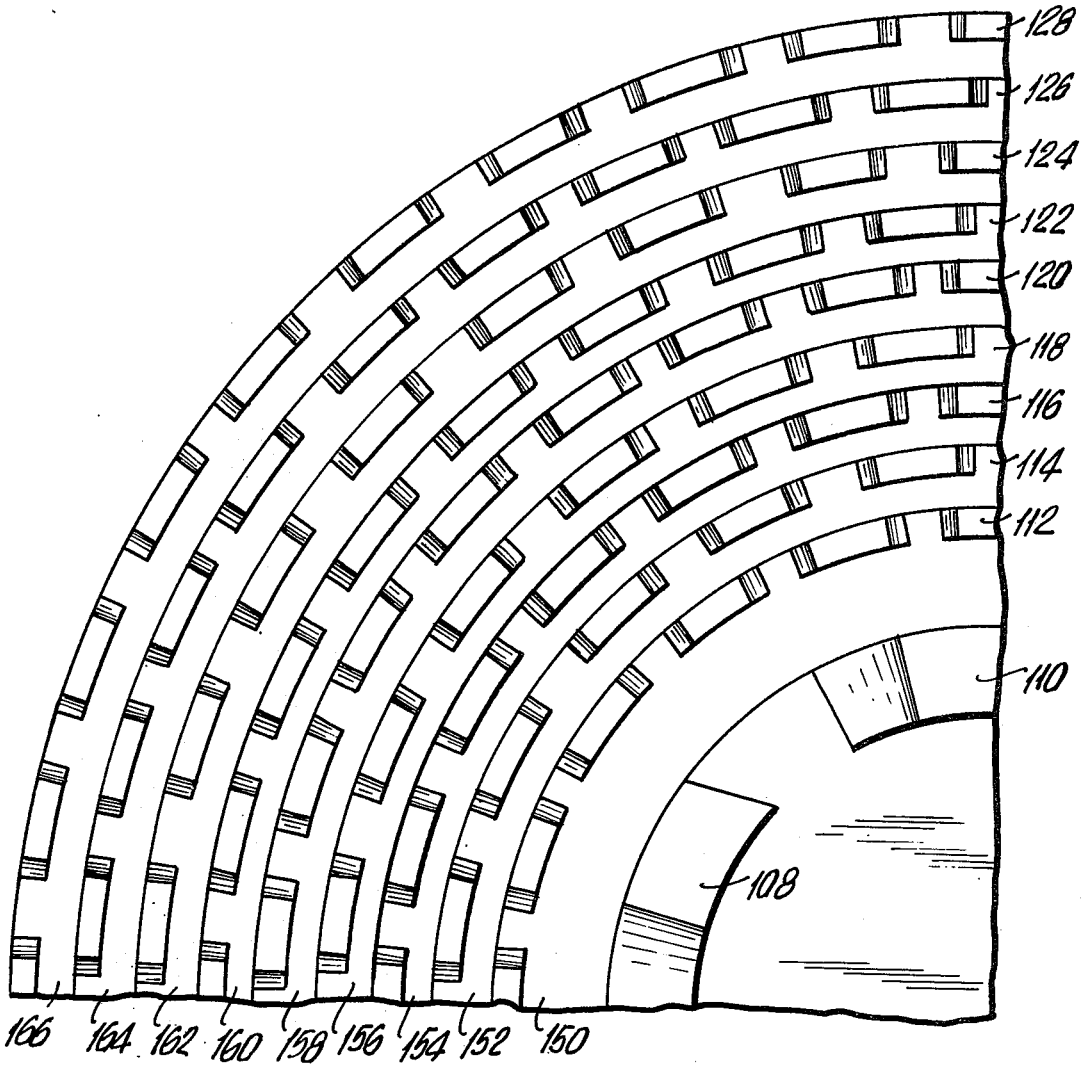
FIG. 4 is a top view of one quadrant of the rotor member of FIG. 3.

For purposes of this discussion, one embodiment of the rotor tooth array 102 will be discussed in detail but the configurations of the rotor teeth in each of the arrays 102 and 104 are substantially identical so that the following description will apply to both of these arrays of teeth. FIG. 4 shows the rotor tooth array 102, which includes a first group of identical relatively large teeth 108 arranged in an inner circumferential ring 110 about the central aperture 84 of rotor 70. As can best be seen in FIG. 3, the exterior convex conical surface of rotor portion 76 is subdivided into a number of substantially flat concentric ring-like steps 130, 132, 134, 136, 138, 140, 142, 144 and 146 descending from flat portion 78 of rotor portion 72. Nine concentric circularly disposed groups 112, 114, 116, 118, 120, 122, 124, 126 and 128 of substantially identical teeth are arranged respectively along the ring-like steps 130, 132, 134, 136, 138, 140, 142, 144 and 146. The individual teeth of each such group are attached to the surface of the respective ring-like step at equally spaced circumferential points. From the inner step 130 closest to the central axis of rotor 70 to the outermost step 146 at the periphery of rotor member 70 the number of teeth which can be accommodated by each such step gradually increases.

A top view of one quadrant of a possible configuration of these teeth is shown in FIG. 4. Utilizing this particular configuration it has been found that the number of teeth in rings 112 and 114 is 20, in rings 116 and 118 is 24, rings 122 and 124 is 30 and in rings 126 and 128 is 36. As can also be seen in FIG. 4, each ring of teeth is positioned along a circle about the outer radial edge of the step to which it is attached with the teeth being aligned substantially in a circumferential direction. A number of circular spaces or channels 150, 152, 154, 156, 158, 160, 162, 164, 166 and 168 are formed on the ring-like steps between adjacent rows of teeth. The stator teeth which are substantially identically arranged on the concave conical surface of the adjacent stator members 18 and 20 pass within these spaces when the rotor is turning.

Individual teeth in each ring subtend substantially equal radial angles and have substantially equal spacing between adjacent teeth in each ring. The radial angle subtended by individual teeth in the outer ring 128 is somewhat less than that subtended by individual teeth in the innermost ring 112. In the particular embodiment represented by FIG. 4, the radial angle between the leading edges of adjacent teeth in each row is as follows 10° for rows 128 and 126; 12° for rows 124 and 122; 15° for rows 120 and 118; 18° for rows 120 and 118 and 60° for the larger teeth 108 in row 110. Similarly, the spacing between individual teeth varies from row to row but in general the radial angle subtended by the space between adjacent teeth in each row is approximately equal to the radial angle subtended by the teeth in that row.

As indicated, the above description includes but one of a virtually infinite number of arrangements of teeth. It would, for instance, be perfectly acceptable to use more or less rings of teeth or to utilize additional rings of the larger teeth 108 interspersing these rings of larger teeth between the rings of smaller teeth. It would also be perfectly acceptable to vary the numbers of teeth in each such ring. For instance, the inner ring 110 has six of the larger teeth 108 in the embodiment shown herein but any number of such teeth within the range of two or ten will provide adequate results.

Figure 5:
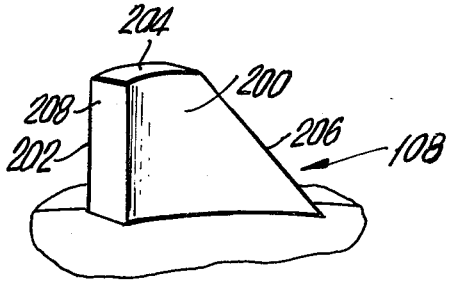
FIG. 5 is a perspective view of one of a first type of teeth utilized in the mixing head of FIG. 2.

The shape of the teeth in the array 102 provides unique advantages over prior art mixer teeth. One of the larger teeth **108*a* of inner circular group 110 is shown in detail in FIG. 5. This tooth includes an inner and an outer circumferential surfaces 200 and 202. The outer circumferential surface 202 is curved to form a sector of a first circle about the axis of rotor 70 along the outer circumference of planar surface 78 while the inner surface 200 is curved along a smaller concentric circle about the central axis of the rotor. The outer surface 202 may slope inwardly slightly so that the radial depth of the tooth decreases gradually from a maximum at its base where it is attached to the surface 78 to a minimum at the top surface 204. The radial leading edge of tooth 108 is formed by a sloping surface 206 which intersects the surface 78 to form an angle within the range of 10° to 80° and preferably about 45° as measured between surfaces 206 and 78. The trailing radial edge 208 may be oriented substantially perpendicularly to the surface 204 or may slope in a manner similar to surface 206. In the embodiment shown, the top 204 of each larger tooth 108 is approximately $\frac{1}{3}$ as long in a circumferential direction as is the base of the tooth. This ratio of top to base lengths will of course vary with the slope of the radial sides and the circumferential length of each tooth. In the embodiment shown, six of these larger teeth 108 comprise the inner circle 110 with the teeth being arranged so that the leading edge 206 of one tooth is adjacent to the trailing edge 208 of the next. In the embodiment shown in the drawings each of the large teeth 108 subtends an angle of approximately 30° measured along its base and the trailing edge 208 of each tooth 108 is spaced along the surface 78, a radial angle of approximately 30° from the leading edge 206** of the adjacent following tooth.

Figure 6:
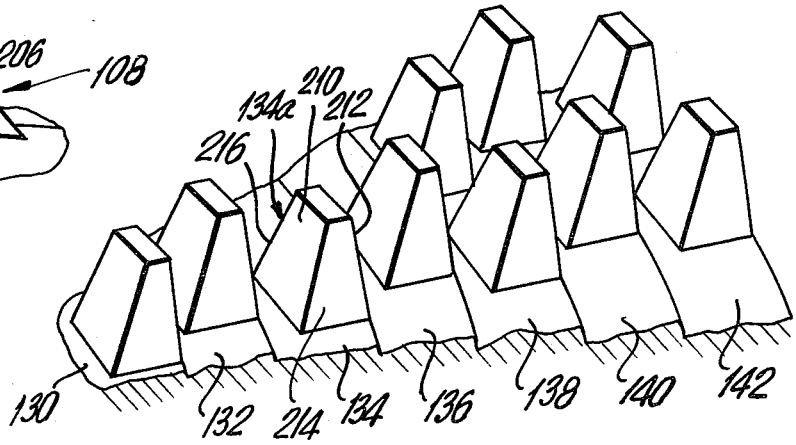
FIG. 6 is a perspective view of a portion of one surface of the rotor member of FIG. 3.

Moving radially outwardly from the first circular group 110 composed of larger teeth 108 each of the circular groups 112 through 128 comprise pluralities of teeth as described below. A few of these teeth are shown in FIG. 6, which shows a portion of the array of teeth 102 on rotor member 70 showing a portion of several circular groups of teeth. Each tooth such as tooth 134*a* which is taken as exemplary includes two radial sides 214 and 216 one or both of which may be tapered. An angle of taper within the range of 5° to 30° with respect to a line parallel to an axis defined by shaft 60 provides good mixing in an axial direction. The circumferential sides 210 and 212 are also tapered inwardly from the base to the top 218 on one or both of their circumferential sides. It has been found that an angle of taper within the range of 1° to 10° with respect to a line parallel to the axis defined by shaft 60 provides teeth of adequate strength and permits acceptable packing density for such teeth.

In the embodiment shown, each of the teeth in rows 112 through 128 are tapered and configured as described above. It is to be understood however that teeth having the inventive configuration may be interspersed with prior art teeth and some improvement in mixing will result.

Figure 7:
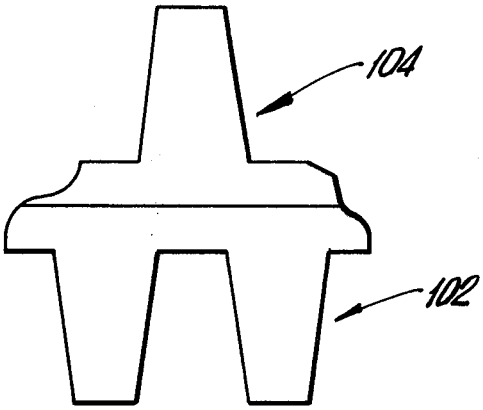
FIG. 7 is a side view of a portion of the rotor member of FIG. 3.

FIG. 7 shows a partial sectional view taken through the rotor member 70 and showing portions of tooth arrays 102 and 104 in the outer rows of teeth on the two opposed sides of the rotor. If desired, as can be seen from the teeth shown the arrays of teeth 102 and 104 may be rotated slightly with respect to each other so that the teeth in array 104 are placed where there are gaps in the array 102 and vice versa. In practice this result can be achieved by rotating the tooth array 104 approximately 5° with respect to array 102. Other than this rotation the arrays of teeth 102 and 104 are identical.

Figure 8:
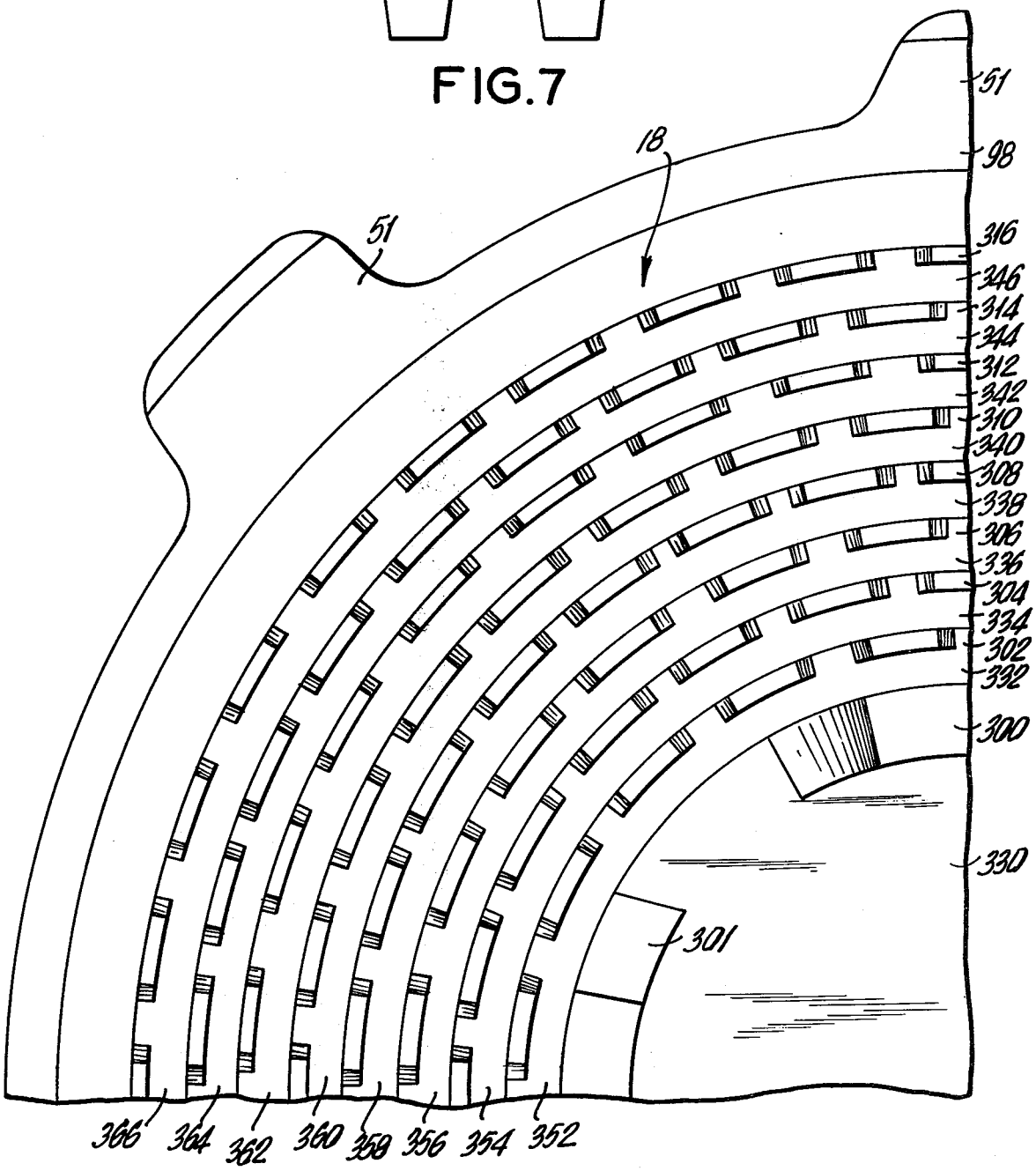
FIG. 8 is a top view of one quadrant of one of the stator members shown in FIG. 2.

FIG. 8 shows a single quadrant of the concave truncated conical surface 98 of stator member 18 showing the tops of the teeth of stator tooth array 94. For purposes of this discussion stator tooth array 94 will be discussed in detail but the configurations of the stator teeth in each of the arrays 94 and 96 are substantially identical so that the following description will apply to both of these arrays of teeth. A first group of identical relatively large teeth 301 are arranged in an inner circumferential ring 300 about the central aperture 48 of stator member 18. The interior concave conical surface of stator member 18 is subdivided into a number of substantially flat concentric ring-like steps 330, 332, 334, 336, 338, 340, 342, 344 and 346 ascending from the first step 330 forming the flat portion of member 18. Eight concentric circularly disposed groups 302, 304, 306, 308, 310, 312, 314 and 316 of substantially identical teeth are arranged respectively along the ring-like steps 332, 334, 336, 338, 340, 342, 344 and 346.

The individual teeth of each such group are attached to the surface of the respective ring-like step at equally spaced circumferential points. From the inner step 330 closest to the central axis to the outermost step 346 at the periphery or stator member 18 the number of teeth which can be accommodated by each such step gradually increases. Utilizing the particular configuration of FIG. 8 it has been found that the number of teeth in circular groups 302 and 304 is 20, in 306 and 308 is 24, in 310 and 312 is 30 and in 314 and 316 is 36. The inner ring 300 comprises six of the larger teeth described above. As can also be seen in FIG. 8 each ring of teeth is positioned along a circle about the outer radial edge of the step to which it is attached with the longer axis of each of the teeth being aligned in a circumferential direction. A number of circular spaces or channels 352, 354, 356, 358, 360, 362, 364 and 366 are formed on the ring-like steps between adjacent rows of teeth. The rotor teeth described above move within these spaces when the rotor is turning.

In the embodiment shown, individual teeth in each of the circular groups subtend substantially equal radial angles and have substantially equal spacing between adjacent teeth. This, however, is not necessary and can be varied in other configurations. The radial angle subtended by individual teeth in the outer ring 316 is somewhat less than that subtended by individual teeth in the innermost ring of smaller teeth 302. In the particular embodiment represented by FIG. 8 the radial angle between the leading edges of adjacent teeth in each row is as follows 10° for rows 316 and 314; 12° for rows 312 and 310; 15° for rows 308 and 306; 18° for rows 304 and 302; and 60° for the larger teeth 301 in row 300. Similarly, the spacing between individual teeth varies from row to row but in general the radial angle subtended by the space between adjacent teeth in each row is approximately equal to the radial angle subtended by the teeth in that row.

As indicated, the above description includes but one of a virtually infinite number of arrangements of teeth. It would, for instance, be perfectly acceptable to use more or less rings of teeth or to utilize additional rings of the larger teeth 108 interspersing these rings of larger teeth between the rings of smaller teeth. It would also be perfectly acceptable to vary the numbers of teeth in each such ring. For instance, the inner ring 110 has six of the larger teeth 108 in the embodiment shown herein but any number of such teeth within the range of two to ten will provide adequate results.

The configuration of the individual stator teeth is preferably identical to that described above with reference to the rotor teeth 108 and 134*a*. The two types of teeth used in the rotor are also used in the stator. As can be seen by comparing FIGS. 4 and 8, the rotor surface may include one more rows of teeth than the stator so that each row of stator teeth passes between rows of rotor teeth, but other configurations having differing numbers of rotor and stator teeth will also provide adequate results.

As indicated above the teeth on the rotor and stator arrays preferably both utilize the two types of teeth described above having the unique tapered configuration disclosed herein. It is possible, however, to utilize prior art rectangular teeth on either the rotor or stator members, if desired, when the spacing of the rows of teeth are adjusted to compensate for this change. A greater improvement in mixing is realized by utilizing the improved teeth on the rotor member if in fact they are just to be used on either the rotor or the stator but some improvement is realized in either case. If desired, the improved teeth can be interspersed with prior art teeth on either the rotor or stator and some corresponding improvement will result.

The circumferential taper of the teeth is primarily done to improve the packing density of the teeth while the radial taper primarily is used to improve mixing in an axial direction extending along the projecting teeth. Clearly, then one of these features can be used without the other. It has been found, however, that tapering the teeth in both the radial and circumferential dimensions provides a mixing head of superior mixing capabilities.

The operation of the novel continuous mixer will now be described with particular reference to FIGS. 2, 3 and 9. Semi-fluid material enters housing 56 through inlet aperture 58. Agitator assembly 61 is rotated by shaft 60 in a clockwise direction looking in the direction of "A" FIG. 2 within the housing 56. During rotation the first agitator 62 causes the semi-fluid material to move radially outwardly from shaft 60 along sloping blade surfaces 69 and curved surfaces 73. As the semi-fluid material moves through the housing 56 to the right as seen in FIG. 2, it encounters the second agitator 64 where it is again moved radially by blades 75. Since agitator 64 is reversed with respect to agitator 62 the motion of the semi-fluid material over the blades 75 will be reversed to the motion caused by blades 68 of agitator 62. The semi-fluid material will tend to be impelled inwardly toward the axis of shaft 60 by sloping blade surface 77 and by curved surfaces 81. Both agitators provide an overall motion of the material in a radial direction with respect to the shaft 60 to provide a preliminary mixing before the material enters the mixing head.

Some degree of premixing would be provided by a single agitator such as 62. An additional degree of premixing is provided by adding more agitators such as 64. Reversing the additional agitator 64 relative to agitator 62 provides a greater degree of radial motion in the passing material. It is to be understood, however, that the inventive agitator assembly will operate regardless of the orientation of the individual agitators or of the orientation of these agitators relative to each other. If desired, the continuous mixer to be described below can be operated without the agitator shown as 61 or with any number of agitator blades such as 62 and 64 which blades can be in the same or opposed orientations. It has been found that the configuration shown as 61 in FIG. 9 performs well with the continuous mixer described herein.

The semi-fluid material emerges from housing 56 along the central axis of the mixing head 12 around shaft 60 and encounters the rotating rotor member 70 at the planar surface 82 of the rear rotor member 74. The inner ring 110 of larger teeth 108 first encounters the material and the sloping leading edge 206 of each of the teeth 108 causes the material to move in an axial direction along the rotor and the stator teeth. Since the larger teeth 108 are heavy and include a large sloping surface they impart considerable extra axial mixing effect on the material as it enters the mixing head.

Because of the rotation of rotor member 70, and the pressurization of the incoming material, the material spreads radially outwardly from the central axis and the shaft 60 between the concave and convex truncated conical surfaces of the rotor portion 74 and stator member 96. In the course of spreading radially the material passes between the teeth on the inner concave surface of stator member 20 and the outer convex surface of rotor portion 74. As described above, the teeth on these members are arranged to interdigitate as rotor 70 is rotated so that the semi-fluid material is beaten and mixed by each ring of teeth in turn as it moves radially outwardly toward the outer circumference of the rotor member 70.

Because the radial leading edge of each tooth in each ring is sloped so that the teeth tapers from a maximum width at its base to a minimum width at its top there is a tendency for the material to move in an axial direction along the sloping sides of the rotor teeth and along the corresponding sloping surfaces of the stator teeth. The in and out motion thus established provides a mixing action lacking in continuous mixers with prior art rectangular teeth. The slope of the individual teeth in the circumferential direction provides individual teeth which are narrower at their outer ends where they are interdigitated with other similar teeth. This in turn permits closer teeth spacing on both rotor and stator surfaces resulting in more teeth and better overall mixing in a given head size. Since the teeth are sloped preferably on all four sides the base where they are under greatest stress is their widest and hence strongest point.

After the semi-fluid material has migrated to the outer circumference of the rotor 70 it passes over the edge of the rotor member and moves inwardly from the circumference of the rotor member toward the axis of shaft 60 passing between the interdigitated teeth on rotor portion 72 and stator member 18. Since these teeth are also tapered along their radial sides the material is again subjected to an in and out axial motion. The mixed material passes out of the head through aperture 48 in stator member 18 passing an additional array 110 of larger teeth which provide an additional axial mixing effect.

Because the stator is non-planar it has increased mechanical strength. The conical shape of the rotor member 70 provides a cavity 92. If desired, a coolant may be circulated through the cavity 92 to dissipate heat in the rotor. Cooling is provided by circulating a fluid coolant through cavities 36 and 44 on stator members 18 and 20 respectively but it may also be desirable to cool the rotor member 70. Because of the violent motion to which it is subjected the semi-fluid material being mixed becomes warmer as it passes around the head 12. Many subsequent operations require material of a predetermined maximum temperature so that excess heat acquired in passing through the mixing head must be dissipated by additional cooling steps. By circulating coolant through a cooling cavity 92 in the rotor member as well as cavities 36 and 44 this undesired heat can be greatly decreased and often eliminated within the continuous mixer. For some applications it is occasionally desirable to add heat to the material being mixed. A heated fluid may be circulated through cavities 36, 44 and if desired 92, to accomplish the needed heating.

Although the present invention has been described in conjunction with preferred embodiment, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. Mixing apparatus including a rotatable shaft disposed along an axis;

a rotor member having a first and a second mutually opposed substantially conical rotor surfaces and a centrally disposed aperture configured to fit slidably over said shaft;

means to attach said rotor member to said shaft;

first and second pluralities of rotor teeth attached to and projecting respectively outwardly from said first and second rotor surfaces;

a stator assembly having first and second stator members, said stator members having outer surfaces and substantially conical stator surfaces, said stator surfaces being disposed respectively adjacent to said first and second surfaces of said rotor assembly;

first and second pluralities of stator teeth attached to and projecting respectively outwardly from each of said first and second stator surfaces such that said stator teeth interdigitate with said rotor teeth; and agitator means attached to said rotatable shaft, said agitator means being spaced longitudinally along said rotatable shaft from said rotor member.

2. Mixing apparatus as claimed in claim 1 in which said agitator means includes a cylindrical member configured to fit slidably over said shaft and at least one agitator, said agitator including at least one blade attached to and extending outwardly from said cylindrical member said blade having a first and second opposed lateral surface and a first and second opposed longitudinal surface and a top surface, said first longitudinal surface being substantially tangent to said cylindrical member and extending outwardly from said cylindrical member in a predetermined direction to said top surface and said second longitudinal surface curving inwardly from said top surface to said cylindrical member.

3. Mixing apparatus as claimed in claim 2 in which said agitator includes at least two of said blades which are attached to said cylindrical member respectively at substantially equally spaced circumferential points and extend outwardly from said cylindrical member in said predetermined direction.

4. Mixing apparatus as claimed in claim 2 including a first and a second of said agitators mounted at longitudinally spaced points along said cylindrical member, said first and second agitators including respectively a first and second pluralities of said blades, and in which said first plurality of blades comprising said first agitator extends outwardly from said cylindrical member in clockwise orientation and in which said second plurality of blades comprising said second agitator extend outwardly from said cylindrical surface in a counter clockwise orientation.

5. An agitator assembly including:

a housing;

a rotatable shaft mounted within said housing;

a cylindrical member attached to said shaft;

first and second agitator members mounted at longitudinally spaced points along said cylindrical member, said first and second agitator members including first and second pluralities of blades, each of said blades having first and second opposed lateral surfaces, first and second opposed longitudinal surfaces and a top surface, said first longitudinal surface defining a plane substantially tangent to said cylindrical member and extending outwardly from said cylindrical member in a predetermined direction to said top surface and said second longitudinal surface curving inwardly from said top surface to said cylindrical member, and in which the blades of said first plurality of blades comprising said first agitator extend outwardly from said cylindrical member in a clockwise orientation and in which the blades of said second plurality of blades comprising said second agitator extend outwardly from said cylindrical surface in a counter clockwise orientation.

6. An agitator including a substantially cylindrical member having an aperture extending along its central axis and at least one circular array of blades comprising a plurality of blades projecting outwardly from said cylindrical member at points equally spaced about the outer circumference of said cylindrical member, each of said blades having first and second opposed lateral surfaces, first and second opposed longitudinal surfaces and a top surface, said first longitudinal surface extending along a plane substantially tangent to said cylindrical member and extending outwardly from said cylindrical member in a predetermined direction to said top surface and said second longitudinal surface being an arcuate surface curving inwardly from said top surface to said cylindrical member where it joins with the first longitudinal surface of the next succeeding blade, and all of said blades extending outwardly from said cylindrical surface in the same directional orientation.

7. An agitator as claimed in claim 6 in which said plurality of blades includes at least six blades.

8. An agitator as claimed in claim 6 including first and second said pluralities of blades mounted at longitudinally spaced points along said cylindrical member in which the blades of said first plurality of blades extend outwardly from said cylindrical member in a clockwise directional orientation and in which said blades of said second plurality of blades extend outwardly from said cylindrical member in a counter clockwise directional orientation.

* * * * *